US011751672B1

(12) United States Patent
Lonsky et al.

(10) Patent No.: US 11,751,672 B1
(45) Date of Patent: Sep. 12, 2023

(54) TOOL TETHERING SYSTEM

(71) Applicants: William Lonsky, Brooklyn Park, MN (US); Michael Alan Christy, Andover, MN (US)

(72) Inventors: William Lonsky, Brooklyn Park, MN (US); Michael Alan Christy, Andover, MN (US)

( * ) Notice: Subject to any disclaimer, the term of this patent is extended or adjusted under 35 U.S.C. 154(b) by 0 days.

(21) Appl. No.: 17/028,890

(22) Filed: Sep. 22, 2020

(51) Int. Cl.
*A45F 5/00* (2006.01)
*A45F 5/02* (2006.01)

(52) U.S. Cl.
CPC ..... *A45F 5/021* (2013.01); *A45F 5/004* (2013.01); *A45F 2005/006* (2013.01); *A45F 2005/026* (2013.01); *A45F 2200/0575* (2013.01)

(58) Field of Classification Search
CPC ..... A45F 2005/006; A45F 2005/1073; A45F 2005/026; A45F 3/06; A45F 2200/0575; Y10S 24/53; Y10T 403/7005; Y10T 403/707; Y10T 403/592; F16B 7/20; F16B 21/165; F16B 2/16; F16B 21/073; B25B 3/0035
See application file for complete search history.

(56) References Cited

U.S. PATENT DOCUMENTS 2,642,689 A * 6/1953 Cline ..... F41C 23/02 24/607
4,362,414 A * 12/1982 Volz ..... A45F 5/02 403/349
4,685,237 A * 8/1987 Hugg ..... F41C 23/02 403/349

* cited by examiner

*Primary Examiner* — Adam J Waggenspack
(74) *Attorney, Agent, or Firm* — JOHNSON AND PHUNG; Thomas N. Phung

(57) ABSTRACT

A tool tethering device that includes a lockable shaft having a cylindrical shaped body with a protruding member located proximal a first end and extending perpendicular from the cylindrical shaped body, a rigid sleeve housing having a cylindrical shaped cavity located within and extending from an open end to a closed end of the rigid sleeve housing, a protruding member engaging slot extending from and running parallel the cylindrical shaped cavity, a ball bearing engaging groove located within the cavity, a protruding member locking groove located within the sleeve housing proximal the closed end of the housing and extending perpendicular the cavity, and a displaceable platform located within the cylindrical shaped cavity between the protruding member locking groove and the closed end of the rigid sleeve housing, the displaceable platform supported by a spring located between the platform and the closed end of the rigid sleeve housing.

20 Claims, 5 Drawing Sheets

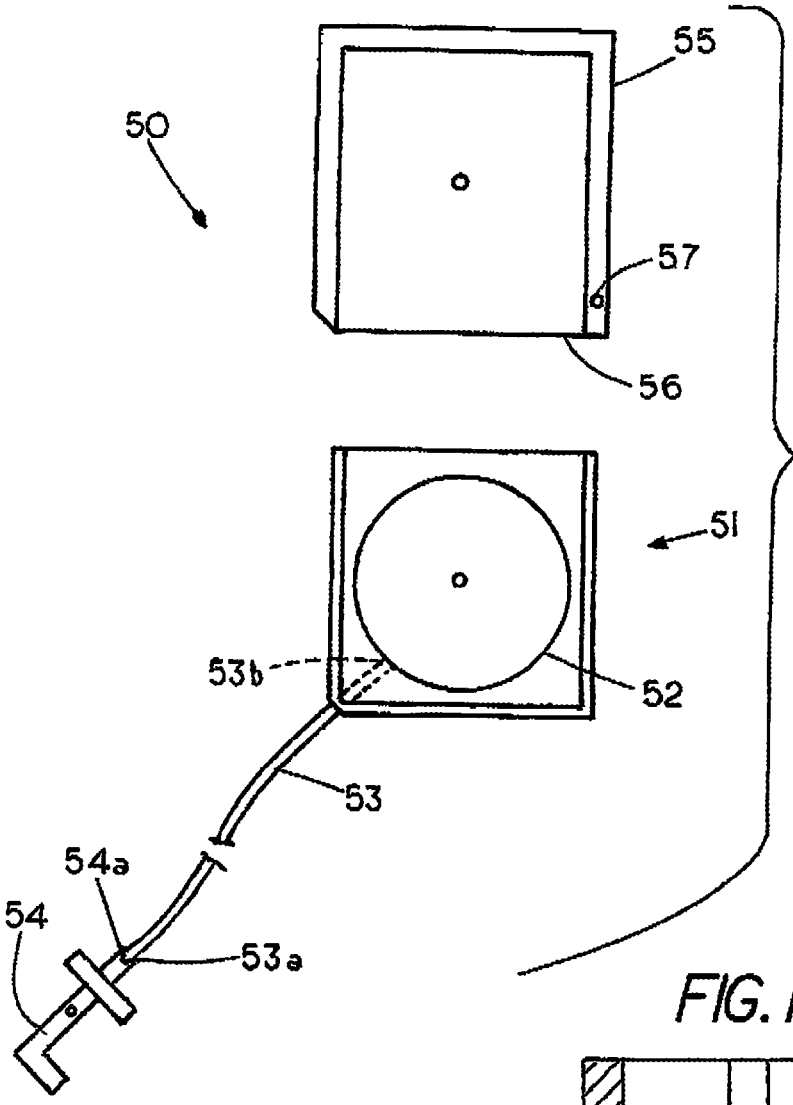
FIG. 11
FIG. 12
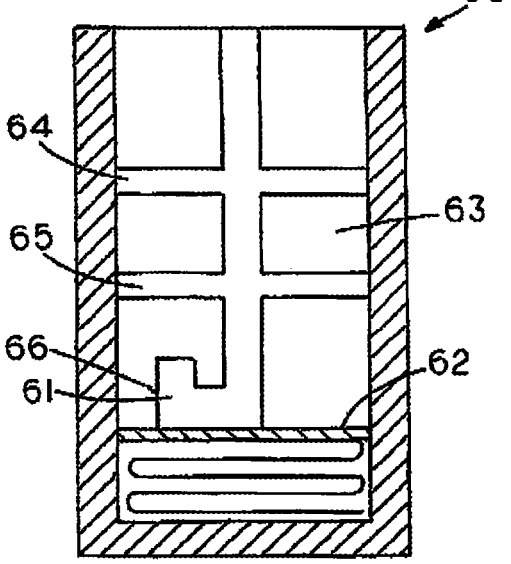

TOOL TETHERING SYSTEM

FIELD OF THE INVENTION

This invention relates generally to handheld tools and, more specifically to a tool tethering system.

CROSS REFERENCE TO RELATED APPLICATIONS

None

STATEMENT REGARDING FEDERALLY SPONSORED RESEARCH OR DEVELOPMENT

None

REFERENCE TO A MICROFICHE APPENDIX

None

BACKGROUND OF THE INVENTION

Workers that use handheld tools as a part of their job typically carry their tools with them on their bodies such as through the use tool belts or holsters so that they may have quick access to their tools, especially if they are working in remote, high, and/or confined locations.

It is not an uncommon occurrence that these handheld tools carried by and/or in use by the worker may accidentally fall out of the user's hand, which may be potentially dangerous to people that are located below if the worker is working on an elevated site such as a scaffolding, ladder, or roof top. Although usually not dangerous, the accidental fall of the handheld tools by the worker in remote and/or confined space often lead to frustration and a waste of precious work hours due to the time involved in retrieving the tools.

The present invention provides for a tool tethering system to not only prevent the accidental fall of the handheld tool during use from a remote and/or confined location but also allowing for user retrieval of the handheld tool in the event of the accidental displacement of the handheld tool and to promote proper safety protocols of continuous transfer to tools and other work related components.

SUMMARY OF THE INVENTION

Briefly, the present invention comprises a tool tethering system that includes a lockable shaft having a cylindrical shaped body with a first end and a second end and at least one lockable ball bearing located between the first end and the second end of the cylindrical shaped body. The shaft includes at least one protruding member located proximal the first end and extending in a perpendicular direction from the cylindrical shaped body.

The tool tethering system also includes a rigid sleeve housing having an open end and a closed end and a cylindrical shaped cavity located within and extending from the open end to the closed end of the rigid sleeve housing. The cylindrical shaped cavity includes at least one protruding member engaging slot extending from and running parallel the cylindrical shaped cavity and at least one ball bearing engaging groove located within the cavity between the open end and the closed end of the rigid sleeve housing.

The cylindrical shaped cavity also includes at least one protruding member locking groove located within the rigid sleeve housing proximal the closed end of the rigid sleeve housing and extending perpendicular from the cavity. The locking groove functions to provide for the locking of the lockable shaft to the rigid sleeve housing by the engagement of the protruding member to the locking groove through the axial rotation the lockable shaft when support within the rigid sleeve housing. The protruding member may comprise various shapes including a general block shape and an L-shaped and the protruding member locking groove will a corresponding shape to match the shape and size of the protruding member to allow for the mating of their surfaces.

The tool tethering system further includes a displaceable platform located within the cylindrical shaped cavity between the protruding member locking groove and the closed end of the rigid sleeve housing, the displaceable platform supported by a compression spring located between the displaceable platform and the closed end of the rigid sleeve housing, the displaceable platform providing supporting engagement to the first end of the lockable shaft.

The tool tethering system may also include a reel assembly having a reel insert with a recoilable spool located therein, a cut-resistant tool tethering cord having a first end attached to the lockable shaft proximal the first end of the lockable shaft and a second end attached to the recoilable spool, and a reel insert housing having a lockable reel insert receiving slot for receiving and maintaining the reel insert within the reel insert housing.

BRIEF DESCRIPTION OF THE DRAWINGS

FIG. 11 is blow-up view showing the general components of a reel assembly;

FIG. 12 is a cross-sectional view showing an alternative embodiment of a rigid sleeve housing;

DESCRIPTION OF THE PREFERRED EMBODIMENT

Figure 1:
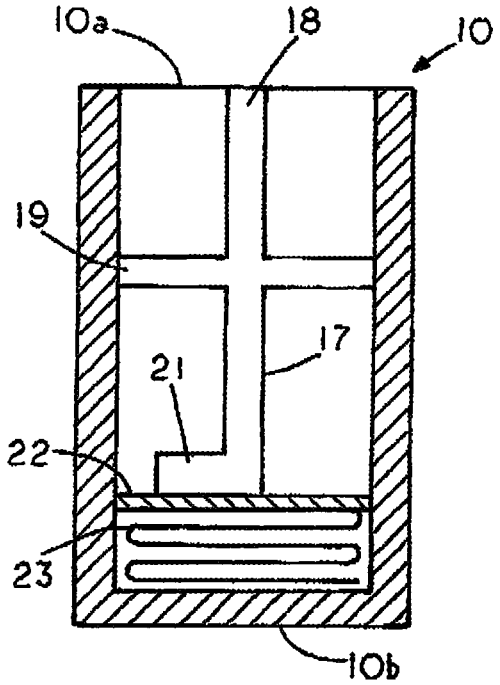
FIG. 1 shows a cross-sectional view of the rigid sleeve housing 10.

The general purpose of the present invention, which will be described subsequently in greater detail, is to provide a tool tethering system to not only prevent the accidental fall of the handheld tool during use from a remote and/or confined location but also allowing for user retrieval of the handheld tool in the event of the accidental displacement of the handheld tool and to promote proper safety protocols of continuous transfer to tools and other work related components.

There has thus been outlined the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the disclosing subject matter be regarded as including such equivalent constructions insofar as they do not depart from the spirit and scope of the present invention.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

In addition, the accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of any potential claims.

Figure 2:
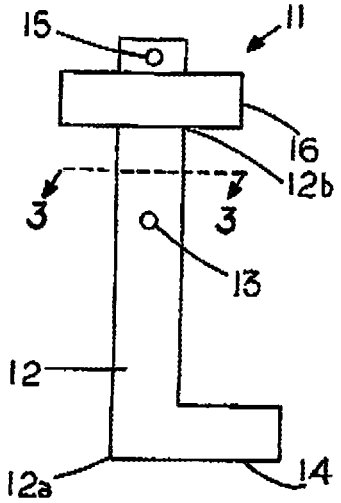
FIG. 2 shows a side view of the lockable shaft.
Figure 3:
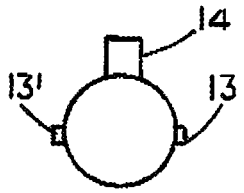
FIG. 3 shows a top view of the lockable shaft of FIG. 3.

Referring to the drawings, FIGS. 1-3 show an embodiment of a tool tethering system of the present invention, which at its basic form generally includes a rigid sleeve housing 10 matingly supporting a lockable shaft 11 therein. More specifically, FIG. 1 shows a cross-sectional view of the rigid sleeve housing 10. FIG. 2 shows a side view of the lockable shaft 11. FIG. 3 shows a top view of the lockable shaft 11 of FIG. 2.

The rigid sleeve housing 10 and the lockable shaft 11 may be made from a variety of material that has sufficient rigidity such as but not limited to a hardened plastic or tempered steel to prevent or reduce loss of shape of the rigid sleeve housing 10 and the lockable shaft 11 after repeated use.

In regards to lockable shaft 11, the lockable shaft 11 includes a cylindrical shaped body 12 having a first end 12*a* and a second end 12*b* and a pair of diametrically opposing lockable ball bearings 13, 13' located between the ends 12*a*, 12*b* of the cylindrical shaped body 12. It is noted that also the embodiment of FIGS. 2 and 3 show the lockable shaft 11 having the pair of diametrically opposing lockable ball bearings 13, 13' located between the ends 12*a*, 12*b* of the cylindrical shaped body 12, alternative embodiments of the present invention may include a lockable shaft having as few as one lockable ball bearing to a plurality of lockable ball bearings located on the cylindrical shaped body with the lockable ball bearings being randomly located on the cylindrical shaped body or fashion in a diametrically opposing manner.

Lockable shaft 11 includes at least one protruding member 14 located proximal the first end 12*a* of lockable shaft 11 and extending in a perpendicular direction from the cylindrical shaped body 12. Lockable shaft 11 may also include an optional cord attachment hole 15 located preferably proximal the second end 12*b* of the cylindrical shaped body 12 and a finger engaging annular member 16 also preferably located proximal the second end 12*b* of the cylindrical shaped body 12.

The rigid sleeve housing 10 includes an open end 10*a*, a closed end 10, and a cylindrical shaped cavity 17 located within and extending from the open end 10*a* to proximal the closed end 10*b* of the rigid sleeve housing 10. The cylindrical shaped cavity 17 includes at least one protruding member engaging slot 18 extending from and running parallel the cylindrical shaped cavity 17 and at least one ball bearing engaging groove 19 located within the cavity 17 between the open end 10*a* and the closed end 10*b* of the rigid sleeve housing 10.

The rigid sleeve housing 10 also includes at least one protruding member locking groove 21 located within the rigid sleeve housing 10 proximal the closed end 10*b* of the rigid sleeve housing 10 and extending perpendicular from the cavity 17 with the locking groove functioning to provide for the locking of the lockable shaft 11 to the rigid sleeve housing 10 by the engagement of the protruding member 14 to the locking groove 21 through the axial rotation the lockable shaft 11 when support within the rigid sleeve housing 10.

The rigid sleeve housing 10 further includes at a displaceable platform 22 located within the cylindrical shaped cavity 17 between the protruding member locking groove 21 and the closed end 10*b* of the rigid sleeve housing 10. The displaceable platform 22 is supported by a spring and preferably a compression spring 23 located between the displaceable platform 22 and the closed end 10*b* of the rigid sleeve housing 10 with the displaceable platform 22 providing supporting engagement to the first end 12*a* of the cylindrical shaped body 12 of lockable shaft 11 through the force exerted on displaceable platform 22 by compression spring 23.

In use of the tool tethering system of FIGS. 1-3, to lock the lockable shaft 11 to the rigid sleeve housing 10 the user inserts the first end 12*a* of the cylindrical shaped body 12 of the lockable shaft 11 into the cylindrical shaped cavity 17 of rigid sleeve housing 10 until the protruding member 14 of the lockable shaft 11 is horizontally aligned with the protruding member locking groove 21 of the rigid sleeve housing 10. It is noted that the horizontally alignment between the protruding member 14 of the lockable shaft 11 and with the protruding member locking groove 21 of the rigid sleeve housing 10 may result in the displacement of the displaceable platform 22 from its normal resting position towards the closed end 10*b* of the rigid sleeve housing 10.

Once the protruding member 14 of the lockable shaft 11 is horizontally aligned with the protruding member locking groove 21 of the rigid sleeve housing 10 the user then rotates or turns the lockable shaft 11 to engage the protruding member 14 with the protruding member locking groove 21 after which the force directed on displaceable platform 22 by spring 23, which is also referred to as a spring loaded force, pushes the protruding member 14 into locking engagement with the protruding member locking groove 21 and the pair of diametrically opposing lockable ball bearings 13, 13' into locking engagement with the corresponding ball bearing engaging grooves 19 of rigid sleeve housing 10.

To unlock and remove the lockable shaft 11 from the rigid sleeve housing 10 the user applies sufficient force on lockable shaft 11 to overcome the force acting on the lockable shaft 11 by spring 23 to displace and unlock the lockable shaft 11 from the protruding member locking groove 21 and unlock the pair of diametrically opposing lockable ball bearings 13, 13' from the corresponding ball bearing engaging grooves 19 of rigid sleeve housing 10. The user then rotates or turns the lockable shaft 11 to disengage the protruding member 14 from the protruding member locking groove 21 after which the lockable shaft 11 may then be removed from the rigid sleeve housing 10.

Figure 4:
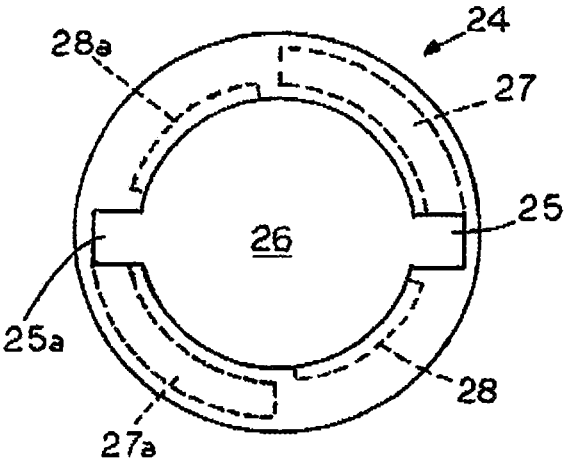
FIG. 4 shows a top view of an alternative embodiment of a rigid sleeve housing.

FIG. 4 shows a top view of an alternative embodiment of a rigid sleeve housing 24 comprising similar component with the rigid sleeve housing 10 of FIG. 1. However, instead of having one protruding member engaging slot, the embodiment of FIG. 4 shows the rigid sleeve housing 24 as having a pair of diametrically opposing protruding member engaging slot 25 and 25*a* extending from and running parallel a cylindrical shaped cavity 26. The rigid sleeve housing 24 also includes a pair of diametrically opposing arc-shaped protruding member locking grooves 27 and 27*a* located within rigid sleeve housing 24 proximal the displaceable platform and extending perpendicular from the cylindrical shaped cavity 26. FIG. 4 also shows rigid sleeve housing 24 as having a pair of diametrically opposing arc-shaped ball bearing engaging grooves 28 and 28*a* located between the ends of the rigid sleeve housing 24.

Figure 5:
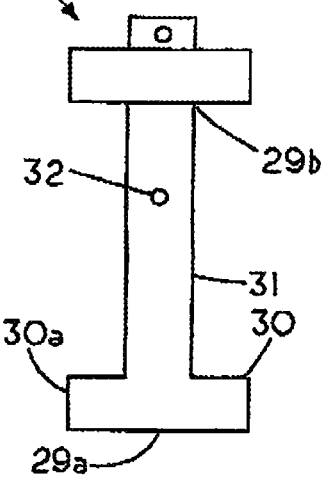
FIG. 5 is a side view showing an alternative embodiment of a lockable shaft mateable with the rigid sleeve housing of FIG. 4.

FIG. 5 is a side view showing an alternative embodiment of a lockable shaft 29 mateable with the rigid sleeve housing 24 of FIG. 4. Lockable shaft 29 includes similar components with the lockable shaft 11 of FIG. 2. However, instead of having one protruding member, lockable shaft 29 includes a pair of diametrically opposing protruding members 30 and 30*a* located proximal a first end 29*a* of lockable shaft 29 and extending in a perpendicular direction with respect to a cylindrical shaped body 31. Lockable shaft 29 also includes a pair of diametrically opposing lockable ball bearings 32 located between the ends 29*a* and 29*b* of the cylindrical shaped body 29.

Figure 6:
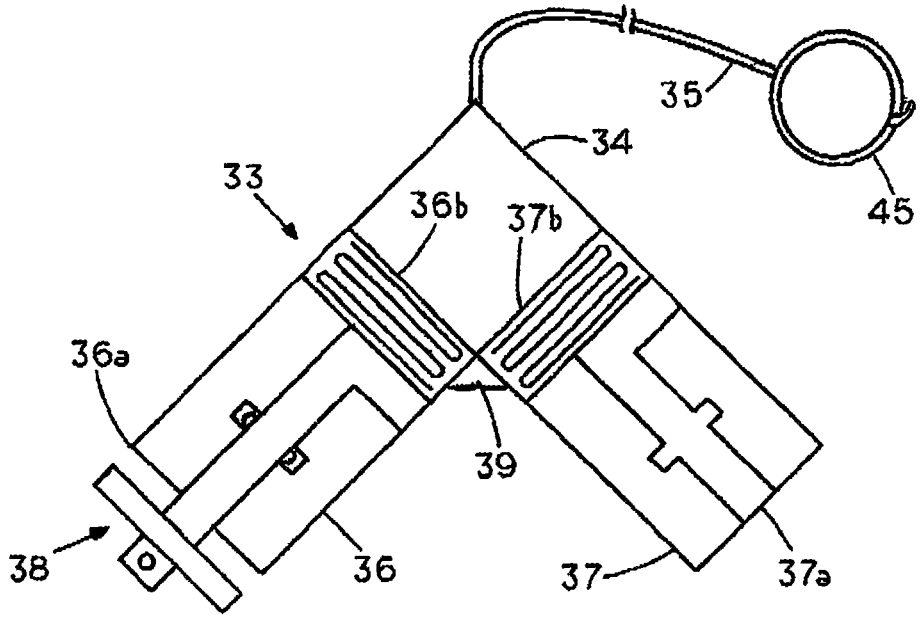
FIG. 6 is a cross-sectional view showing an alternative embodiment of a V-shaped tool tethering device.

FIG. 6 is a cross-sectional view showing an alternative embodiment of a tool tethering device 33 of the present invention, which generally includes a main body 34 having a tool tethering cord 35 attaching the main body 34 to an adjustable band 45, a first rigid housing sleeve 36, a second rigid housing sleeve 37, and at least one lockable shaft 38. In the embodiment of FIG. 6 the tool tethering cord 35 is shown secured to main body 34 through the use of a securing anchor 39.

In regards to lockable shaft 38, lockable shaft 38 is shown as having similar components with the lockable shaft 11 of FIGS. 2 and 3. In regards to rigid housing sleeves 36 and 37, rigid housing sleeves 36 and 37 is shown also having similar components with the rigid sleeve housing 10 of FIG. 1. However, each of the rigid housing sleeves 36 and 37 includes an open end 36*a* and 37*a* and a closed end 36*b* and 37*b* with the closed end 36*b* and 37*b* attached to a portion of the main body and extending from the main body 34 to provide a V-shaped to tool tethering device 33.

Figure 7:
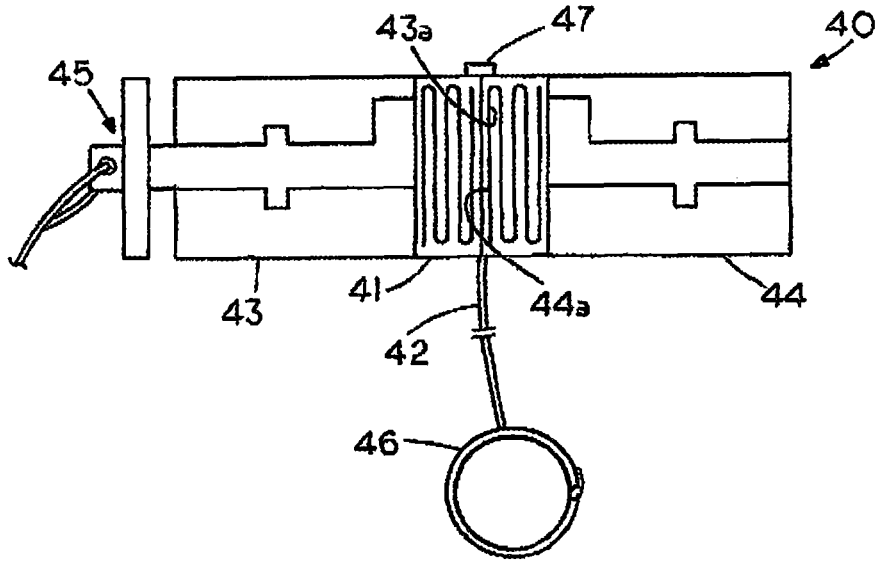
FIG. 7 is a cross-sectional view showing an alternative embodiment of a linear shaped tool tethering device.
Figure 8:
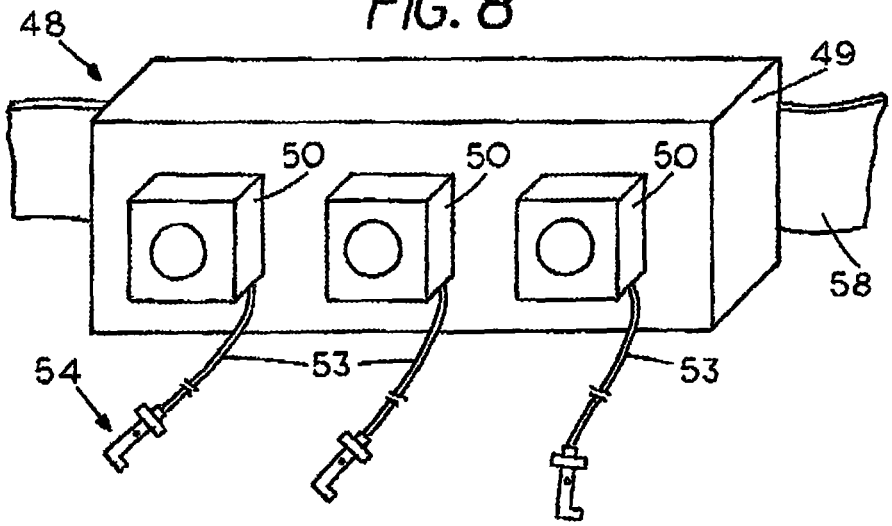
FIG. 8 is a perspective view showing an embodiment of a tool tethering system of the present invention.

FIG. 7 is a cross-sectional view showing an alternative embodiment of a tool tethering device 40 of the present invention similar to the tool tethering device 33 of FIG. 6 in that tool tethering device 40 includes a main body 41 having a tool tethering cord 42 attaching the main body 41 to an adjustable band 46, a first rigid housing sleeve 43, a second rigid housing sleeve 44, and at least one lockable shaft 45. However, unlike the tool tethering device 33 of FIG. 6, each of closed end 43*b* and 44*b* of rigid housing sleeves 43 and 44 are attached to a portion of the main body 41 and extend from the main body 41 in a condition to provide a linear shaped instead of a V-shape to tool tethering device 40. In addition, the embodiment of FIG. 7 also shows the tool tethering cord 35 secured to main body 41 through the use of a securing pin 47.

Figure 9:
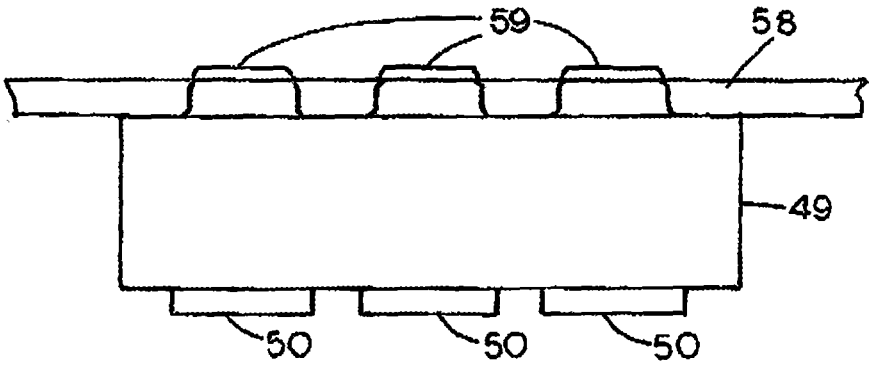
FIG. 9 is a top view of the tool tethering system of FIG. 8.
Figure 10:
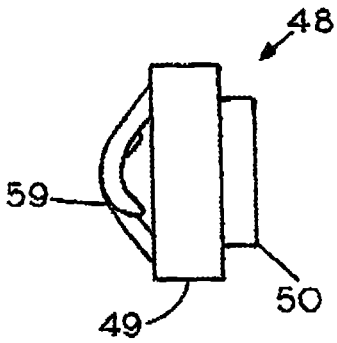
FIG. 10 is a side view of the tool tethering system of FIG. 8.

Referring to FIGS. 8, 9, 10, and 11, FIG. 8 is a perspective view, FIG. 9 is a top view, and FIG. 10 is a side view showing an embodiment of a tool tethering system 48 of the present invention. FIG. 11 is blow-up view showing the general components of a reel assembly 50 of FIGS. 8, 9, and 10. The tool tethering system 48 generally include a belt 58 attached to a belt clip housing 49 having a set of three (3) reel assemblies 50 attached to the belt clip housing 48. The belt 58 is shown attached to a belt clip housing 49 through the use of an opposing double hook belt clip 59.

The reel assemblies 50 each include a reel insert 51 having a recoilable spool 52 located therein with a cut-resistant tool tethering cord 53 having a first end 53*a* attached to the lockable shaft 54 proximal the first end 54*a* of the lockable shaft 54 and a second end 53*b* attached to the recoilable spool 52 and a reel insert housing 55 having a lockable reel insert receiving slot 56 for receiving and maintaining the reel insert 51 within the reel insert housing 55. The reel insert housing 55 is shown including a reel insert release button 57 for assisting in unlocking and displacing the reel insert 51 from the reel insert housing 55.

FIG. 12 is a cross-sectional view showing an alternative embodiment of a rigid sleeve housing 60 that has similar general components with the rigid sleeve housing 10 of FIG. 1. However, unlike rigid sleeve housing 10, rigid sleeve housing 60 includes a L-shaped protruding member locking groove 61 located within the rigid sleeve housing 60 proximal a spring supported displaceable platform 62 and extending perpendicular from a cylindrical shaped cavity 63.

Rigid sleeve housing 60 also includes a first ball bearing engaging groove 64 and a second ball bearing engaging groove 65 located within rigid sleeve housing 60 and running parallel to each other and perpendicular to cylindrical shaped cavity 63.

and a ball bearing engaging groove 66 located within the L-shaped protruding member locking groove 61.

Figure 13:
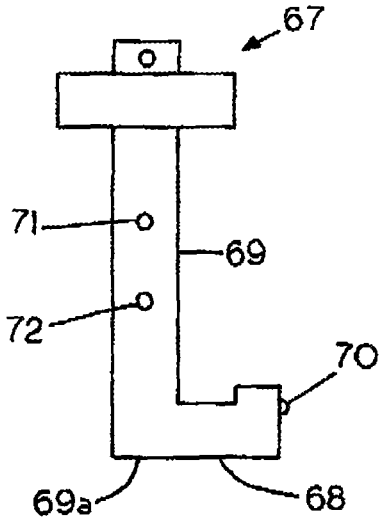
FIG. 13 is a side view showing an alternative embodiment of a lockable shaft.

FIG. 13 is a side view showing an alternative embodiment of a lockable shaft 67 of the present invention similar to the lockable shaft 11 of FIG. 2. The lockable shaft 67 includes an L-shaped protruding member 68 located proximal a first end 69*a* of a cylindrical shaped body 69 of the lockable shaft 67 and extending in a perpendicular direction with respect to the cylindrical shaped body 69. The L-shaped protruding member 68 is engageable with the corresponding L-shaped protruding member locking groove 61 of the rigid sleeve housing 60 of FIG. 12.

The L-shaped protruding member 68 also includes a lockable ball bearing 70 extending therefrom with lockable ball bearing 70 engageable with the corresponding ball bearing engaging groove 66 of FIG. 12 to assist in maintaining the releasable securement of lockable shaft 67 to a rigid sleeve housing 60.

The lockable shaft 67 also includes a first lockable ball bearing 71 and a second lockable ball bearing 72 located along lockable shaft 67 in a position that corresponds to and mateable with the first ball bearing engaging groove 64 and a second ball bearing engaging groove 65 located within rigid sleeve housing 60 to further assist in maintaining the releasable securement of lockable shaft 67 to a rigid sleeve housing 60.

Figure 14:
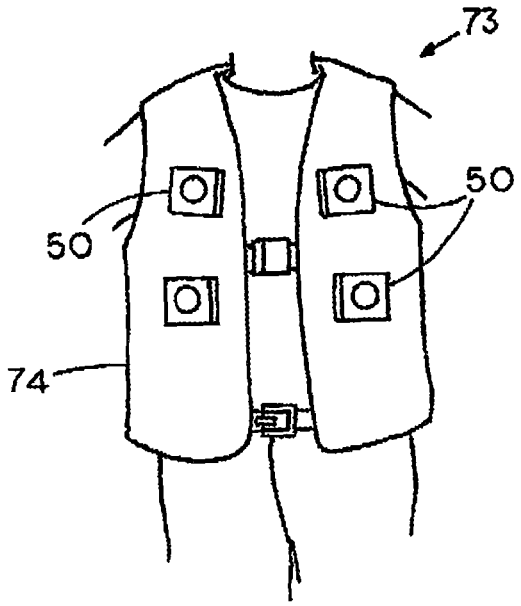
FIG. 14 is a perspective view showing an alternative embodiment of a tool tethering system that includes a safety vest having reel assemblies attached to the safety vest.

FIG. 14 is a perspective view showing an alternative embodiment of a tool tethering system 73 that includes a safety vest 74 having four (4) reel assemblies 50 attached to the safety vest 74.

We claim:

1. A tool tethering system comprising:

a lockable shaft having a cylindrical shaped body with a first end and a second end and at least one lockable ball bearing located between said first end and said second end of said cylindrical shaped body, said shaft including at least one protruding member located proximal said first end and extending in a perpendicular direction with respect to said cylindrical shaped body;

a rigid sleeve housing having an open end and a closed end, a cylindrical shaped cavity located within and extending from said open end to said closed end of said rigid sleeve housing, said cylindrical shaped cavity having at least one protruding member engaging slot extending from and running parallel said cylindrical shaped cavity, said cylindrical shaped cavity including at least one ball bearing engaging groove located within said cavity between said open end and said closed end of said rigid sleeve housing and at least one protruding member locking groove located within said rigid sleeve housing proximal said closed end of said rigid sleeve housing and extending perpendicular from said cavity, said locking groove providing for the locking of said lockable shaft to said rigid sleeve housing by the engagement of said protruding member to said locking groove through the axial rotation said lockable shaft when support within said rigid sleeve housing; and a displaceable platform located within said cylindrical shaped cavity between said protruding member locking groove and said closed end of said rigid sleeve housing, said displaceable platform supported by a compression spring located between said displaceable platform and said closed end of said rigid sleeve housing, said displaceable platform providing supporting engagement to said first end of said lockable shaft.

2. The tool tethering system of claim 1 including a finger support member located proximal said second end of said lockable shaft.

3. The tool tethering system of claim 1 wherein said at least one protruding member comprises a pair of diametrically opposing protruding members located proximal said first end of lockable shaft and extending in a perpendicular direction with respect to said cylindrical shaped body, and said at least one protruding member engaging slot comprises a pair of diametrically opposing protruding member engaging slot extending from and running parallel said cylindrical shaped cavity, and said at least one protruding member locking groove comprises a pair of diametrically opposing protruding member locking grooves located within said rigid sleeve housing proximal said displaceable platform and extending perpendicular from said cylindrical shaped cavity.

4. The tool tethering system of claim 1 wherein said at least one lockable ball bearing comprises a pair of diametrically opposing lockable ball bearings located between said ends of said cylindrical shaped body and said at least one ball bearing engaging groove comprises a pair of corresponding diametrically opposing ball bearing engaging grooves located within said cavity between said open end and said closed end of said rigid sleeve housing.

5. The tool tethering system of claim 1 wherein said protruding member locking groove and said one ball bearing engaging groove each comprises an arc-shaped groove.

6. The tool tethering system of claim 1 wherein said protruding member comprises an L-shaped protruding member located proximal said first end of lockable shaft and extending in a perpendicular direction with respect to said cylindrical shaped body and said protruding member locking groove comprises a corresponding L-shaped protruding member locking groove located within said rigid sleeve housing proximal said displaceable platform and extending perpendicular from said cylindrical shaped cavity.

7. The tool tethering system of claim 1 wherein said protruding member includes a lockable ball bearing extending therefrom and said protruding member locking includes a corresponding ball bearing engaging groove.

8. The tool tethering system of claim 1 including a tethering cord having a first end attached to said lockable shaft proximal said first end of said lockable shaft and a second end attached to a recoilable spool.

9. The tool tethering system of claim 1 including a reel assembly having a reel insert with a recoilable spool located therein, a cut-resistant tool tethering cord having a first end attached to said lockable shaft proximal said first end of said lockable shaft and a second end attached to said recoilable spool, and a reel insert housing having a lockable reel insert receiving slot for receiving and maintaining said reel insert within said reel insert housing.

10. The tool tethering system of claim 1 including a belt clip housing having at least two reel assemblies attached to said belt clip housing, said reel assemblies each including a reel insert having a recoilable spool located therein with a cut-resistant tool tethering cord having a first end attached to said lockable shaft proximal said first end of said lockable shaft and a second end attached to said recoilable spool and a reel insert housing having a lockable reel insert receiving slot for receiving and maintaining said reel insert within said reel insert housing.

11. The tool tethering system of claim 1 including a safety vest having at least two reel assemblies attached to said safety vest, said reel assemblies each including a reel insert having a recoilable spool located therein with a cut-resistant tool tethering cord having a first end attached to said lockable shaft proximal said first end of said lockable shaft and a second end attached to said recoilable spool and a reel insert housing having a lockable reel insert receiving slot for receiving and maintaining said reel insert within said reel insert housing.

12. A tool tethering system comprising:

a main body having a tool tethering cord attached thereto;

at least one lockable shaft having a cylindrical shaped body with a first end and a second end and at least one lockable ball bearing located between said first end and said second end of said cylindrical shaped body, said shaft including at least one protruding member located proximal said first end and extending in a perpendicular direction with respect to said cylindrical shaped body;

at least one rigid sleeve housing extending from said main body, said rigid sleeve housing having an open end and a closed end with said closed end attached to a portion of said main body, a cylindrical shaped cavity located within and extending from said open end to said closed end of said rigid sleeve housing, said cylindrical shaped cavity having at least one protruding member engaging slot extending from and running parallel said cylindrical shaped cavity, said cylindrical shaped cavity including at least one ball bearing engaging groove located within said cavity between said open end and said closed end of said rigid sleeve housing and at least one protruding member locking groove located within said rigid sleeve housing proximal said closed end of said rigid sleeve housing and extending perpendicular from said cavity, said locking groove providing for the locking of said lockable shaft to said rigid sleeve housing by the engagement of said protruding member to said locking groove through the axial rotation said lockable shaft when support within said rigid sleeve housing; and a displaceable platform located within said cylindrical shaped cavity between said protruding member locking groove and said closed end of said rigid sleeve housing, said displaceable platform supported by a compression spring located between said displaceable platform and said closed end of said rigid sleeve housing, said displaceable platform providing supporting engagement to said first end of said lockable shaft.

13. The tool tethering system of claim 12 wherein said at least one lockable ball bearing comprises at least one pair of diametrically opposing lockable ball bearings located between said ends of said cylindrical shaped body and said at least one ball bearing engaging groove comprises at least one pair of corresponding diametrically opposing ball bearing engaging grooves located within said cavity between said open end and said closed end of said rigid sleeve housing.

14. The tool tethering system of claim 13 including a tethering cord having a first end attached to said lockable shaft proximal said first end of said lockable shaft and a second end attached to a recoilable spool.

15. The tool tethering system of claim 13 including a reel assembly including a reel assembly having a reel insert with a recoilable spool located therein, a cut-resistant tool tethering cord having a first end attached to said lockable shaft proximal said first end of said lockable shaft and a second end attached to said recoilable spool, and a reel insert housing having a lockable reel insert receiving slot for receiving and maintaining said reel insert within said reel insert housing.

16. The tool tethering system of claim 15 wherein said protruding member comprises an L-shaped protruding member located proximal said first end of lockable shaft and extending in a perpendicular direction with respect to said cylindrical shaped body and said protruding member locking groove comprises a corresponding L-shaped protruding member locking groove located within said rigid sleeve housing proximal said displaceable platform and extending perpendicular from said cylindrical shaped cavity.

17. The tool tethering system of claim 15 wherein said at least one rigid sleeve housing comprises a first rigid housing sleeve and second rigid housing sleeve with said first and second rigid housing sleeve extending from said main body to form a linear-shaped main body.

18. The tool tethering system of claim 15 wherein said at least one rigid sleeve housing comprises a first rigid housing sleeve and second rigid housing sleeve with said first and second rigid housing sleeve extending from said main body to form a V-shaped device.

19. The tool tethering system of claim 14 including a belt clip housing having at least two reel assemblies attached to said belt clip housing, said reel assemblies each including a recoilable spool located therein, a cut-resistant tool tethering cord having a first end attached to said lockable shaft proximal said first end of said lockable shaft and a second end attached to said recoilable spool, and a reel insert housing having a lockable reel insert receiving slot for receiving and maintaining said reel insert within said reel insert housing.

20. A tool tethering system comprising:

a lockable shaft having a cylindrical shaped body with a first end and a second end and at least one pair of diametrically opposing lockable ball bearings located between said ends of said cylindrical shaped body, said shaft including at least one L-shaped protruding member located proximal said first end of lockable shaft and extending in a perpendicular direction from said cylindrical shaped body and a tethering cord having a first end attached to said cylindrical shaped body proximal said second end of said cylindrical shaped body and a second end attached to an insert clip;

a rigid sleeve housing having an open end and a closed end, a cylindrical shaped cavity located within and extending from said open end to said closed end of said rigid sleeve housing, said cylindrical shaped cavity having at least one protruding member engaging slot extending from and running parallel said cylindrical shaped cavity, said cylindrical shaped cavity including at least one pair of corresponding diametrically opposing ball bearing engaging grooves located within said cavity between said open end and said closed end of said rigid sleeve housing and at least one L-shaped protruding member locking groove located within said rigid sleeve housing proximal said displaceable platform and extending perpendicular from said cylindrical shaped cavity, said locking groove providing for the locking of said lockable shaft to said rigid sleeve housing by the engagement of said protruding member to said locking groove through the axial rotation said lockable shaft when support within said rigid sleeve housing;

a displaceable platform located within said cylindrical shaped cavity between said protruding member locking groove and said closed end of said rigid sleeve housing, said displaceable platform supported by a compression spring located between said displaceable platform and said closed end of said rigid sleeve housing, said displaceable platform providing supporting engagement to said first end of said lockable shaft; and a reel assembly including a reel insert having a recoilable spool located therein with a cut-resistant tool tethering cord having a first end attached to said recoilable spool and a second end attached to a female insert clip receiving housing attachable to said insert clip and a reel insert housing having a lockable reel insert receiving slot for receiving and maintaining said reel insert within said reel insert housing.

* * * * *